US009199104B2

(12) United States Patent
Nie et al.

(10) Patent No.: US 9,199,104 B2
(45) Date of Patent: Dec. 1, 2015

(54) MULTI-FUNCTIONAL LIFTING DEVICE

(71) Applicant: Dongguan Tiannan Optical Tech. Co., Ltd., Dongguan, Guangdong Province (CN)

(72) Inventors: Quan Nie, Dongguan (CN); Youtao Hu, Dongguan (CN); Yong Ge, Dongguan (CN)

(73) Assignee: Dongguan Tiannan Optical Tech. Co., Ltd., Dongguan, Guangdong Province (CN)

( * ) Notice: Subject to any disclaimer, the term of this patent is extended or adjusted under 35 U.S.C. 154(b) by 271 days.

(21) Appl. No.: 14/054,639

(22) Filed: Oct. 15, 2013

(65) Prior Publication Data

US 2014/0209409 A1 Jul. 31, 2014

(30) Foreign Application Priority Data

Jan. 25, 2013 (CN) ..... 2013 1 0028895

(51) Int. Cl.

| | |
|---|---|
| ***B66D 3/08*** | (2006.01) |
| ***A62B 1/14*** | (2006.01) |
| ***A62B 1/06*** | (2006.01) |
| ***B66D 1/74*** | (2006.01) |

(52) U.S. Cl.

CPC ... *A62B 1/14* (2013.01); *A62B 1/06* (2013.01); *B66D 1/7489* (2013.01)

(58) Field of Classification Search

CPC ..... A62B 1/06; A62B 1/08; A62B 1/10; A62B 1/18; B66D 1/12; B66D 1/46; B66D 1/485; B66D 1/7405; B66D 1/7489; B66D 5/16; B66D 5/30

See application file for complete search history.

(56) References Cited

U.S. PATENT DOCUMENTS 5,374,035 A * 12/1994 Santos ..... B66D 1/12 254/323
5,965,994 A * 10/1999 Seo ..... B66D 1/46 212/307
6,027,103 A * 2/2000 Painter ..... B66D 1/12 254/332
2003/0021662 A1* 1/2003 Ramsey ..... B62D 43/045 414/463
2006/0017047 A1* 1/2006 Calver ..... B66D 1/7415 254/411
2006/0273293 A1* 12/2006 Ball ..... A62B 99/00 254/371
2008/0128668 A1* 6/2008 Fofonoff ..... B66D 1/46 254/334
2008/0157042 A1* 7/2008 Jacobson ..... B66B 9/00 254/270
2008/0203370 A1* 8/2008 Ball ..... B66D 1/7415 254/372
2009/0014242 A1* 1/2009 Tang ..... H04Q 9/00 182/241
2010/0051767 A1* 3/2010 Erel ..... B66C 23/02 248/205.1
2010/0163343 A1* 7/2010 Stone ..... A62B 1/10 182/234
2013/0306923 A1* 11/2013 Hua ..... A62B 1/06 254/333
2015/0034894 A1* 2/2015 Ball ..... A62B 1/06 254/385

* cited by examiner

*Primary Examiner* — Emmanuel M Marcelo
(74) *Attorney, Agent, or Firm* — Novoclaims Patent Services LLC; Mei Lin Wong

(57) ABSTRACT

A multi-functional lifting device, comprising a lifting device body; a power source; an electromagnetic DC motor; a decelerator connected to the DC motor; a main moving wheel positioned on an output axle of the decelerator; a rope element twined into the main moving wheel; a resilient wheel brake unit on one side of the main moving wheel locking the rope element into position; an intermediate wheel having a rope groove complementary to the rope groove of the main moving wheel; and a speed control module and a PCB board connected to the DC motor. The multi-functional lifting device is capable of providing controllable upward and downward movement when the power to the DC motor is connected or disconnected to the power source.

6 Claims, 4 Drawing Sheets

MULTI-FUNCTIONAL LIFTING DEVICE

CROSS REFERENCE OF RELATED APPLICATION

This is a non-provisional application that claims the benefit of priority under 35 U.S.C. §119 to a foreign application number 201310028895.5 with a filing date of Jan. 25, 2013 in China. The contents of these specifications, including any intervening amendments thereto, are incorporated herein by reference.

BACKGROUND OF THE PRESENT INVENTION

1. Field of Invention

The present invention relates to a multi-functional device for lifting a loaded person or object to move upwardly or downwardly along a climbing rope, and the speed of upward or downward movement can be controlled. The main applications are for escape from high-rise building, adventure, military climbing and etc.

2. Description of Related Arts

In the fields of travel, sports, firefighting and counter-terrorism, a person may require to use a rope to move up or down along the rope in order to move up or down or to transport an object to a higher level or lower level. Traditionally, a person uses his or her hands to hold the rope directly and utilizes the fictional force between the hands and the rope for upward movement. Accordingly, not only the level of climbing is limited, but also a relative larger manpower is wasted.

Along with the technological development, different types of mechanical and electrical devices are applied in this field. For example, China patent application, publication number: CN1046682A, title: Climbing rope device, discloses a pair of climbing rope device in which the climbing rope device is clipping on the rope body such as steel cable, steel rope, rope or elongated rod which is suspended in the air, wherein alternate movement of hand and leg can result in upward and downward movement of the body, and the body can be maintained at any position on the climbing rope. The characterized features of the pair of climbing rope device includes a pair of sheave units fittingly connected with each other and are capable of having rotational movement at opposite direction, wherein one or both of the sheave units is engraved with protruded groove element, eccentric groove element or unequal ring groove at a middle portion of an outer circumferential area, and a through-hole is defined between the two sheave units for the rope passage. The size of the through-hole is adjustable through the rotational movement of the sheave units. When the size of the through-hole is increased, the climbing rope device can slide along the rope for upward or downward movement; when the size of the through-hole is decreased, the climbing rope device is locked and prevented from movement. The problem of this climbing rope device is that the climbing rope device is a mechanical climbing device which requires the manual movement of hands and legs, wherein the upward movement relies on the power of the person, and the locking position between the climbing rope device and the rope or the rod is achieved by the operation of hands and legs of the person. Accordingly, the operation is inconvenience and the climbing level is limited. On the other hands, the safety and reliability is not guaranteed.

SUMMARY OF THE PRESENT INVENTION

In view of the shortcomings of the climbing rope device of the conventional arts, an object of the present invention is to provide a multi-functional lifting device through which a person or an object is capable of moving upwardly or downwardly along a climbing rope while ensuring that the upward or downward speed can be controlled.

Additional advantages and features of the invention will become apparent from the description which follows, and may be realized by means of the instrumentalities and combinations particular point out in the appended claims.

According to the present invention, the foregoing and other objects and advantages are attained by a multi-functional lifting device, comprising:

a lifting device body;

a power source such as a battery arrangement provided on said lifting device body;

an electromagnetic DC motor installed on the lifting device body and connected to the power source;

a decelerator comprising an input axle connected to an output axle of the DC motor;

a main moving wheel positioned on an output axle of the decelerator;

a rope element twined into a rope groove of the main moving wheel;

a resilient wheel brake unit positioned at an upper portion on one side of the main moving wheel and biased against the rope element and locking the rope element into position;

an intermediate wheel positioned on another side of the main moving wheel, wherein the intermediate wheel has a rope groove complimentary to the rope groove of the main moving wheel such that the rope element is twined between the rope groove of the main moving wheel and the rope groove of the intermediate wheel and the rope element is extended outside through the rope groove of the main moving wheel;

a speed control module and a PCB board positioned on the lifting device body, wherein the speed control module includes a signal output terminal connected to a signal input terminal of the DC motor; and wherein the resilient wheel brake unit includes a roller, a roller shaft for pressing against the rope, a roller shaft axle, an axle pressing unit and a roller axle, wherein the roller is connected to the roller shaft through the roller axle, the roller shaft is connected to the axle pressing unit through the roller shaft axle, the roller shaft is positioned at a bottom portion of the axle pressing unit and is capable of having rotational movement around the roller shaft axle.

Preferably, according to the preferred embodiment of the present invention, if the rope groove of the main moving wheel is N, the rope groove of the intermediate wheel is N−1, where N=3, 4, 5, 6.

Preferably, according to the preferred embodiment of the present invention, the main moving wheel comprises a rope pressing element provided on an upper portion of the main moving wheel, and a steering wheel, a guiding wheel, and a rope coupling unit provided on top of the rope pressing element, wherein the rope coupling unit comprises two coupling wheels positioned opposite to each other to define a passage and the rope element is arranged to pass through the rope passage and then to the rope groove of the main moving wheel through the guiding wheel, steering wheel.

Preferably, according to the preferred embodiment of the present invention, a rope exit element is provided on top of the resilient wheel brake unit.

Preferably, according to the preferred embodiment of the present invention, the lifting device body includes an outer casing, and the outer casing is a water-proof casing, wherein the speed control module include one or more control button arranged on the water-proof casing.

Preferably, according to the preferred embodiment of the present invention, the battery arrangement is integrally provided on a side of DC motor.

The advantageous features of the present invention is that, first, a person or an object is capable of moving upwardly or downwardly along a climbing rope while ensuring that the upward or downward speed can be controlled through the multi-functional lifting device of the present invention; second, the control and upward and downward movement of the multi-functional lifting device can be controlled through the DC motor, while the multi-functional lifting device is disabled and locked when the power to the DC motor is cut off, and the multi-functional lifting device is capable of moving upwardly and downwardly safely and steadily at a constant speed through the speed control module when the power to the DC motor is cut off; third, resilient wheel brake unit is operatively connected to the main moving wheel in such a manner that a heavy object is prevented from free falling and therefore the impact of the heavy object on the DC motor is minimized or eliminated.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The multi-functional lifting device according to the preferred embodiment of the present invention is further described with the accompanying drawings as follows.

Figure 1:
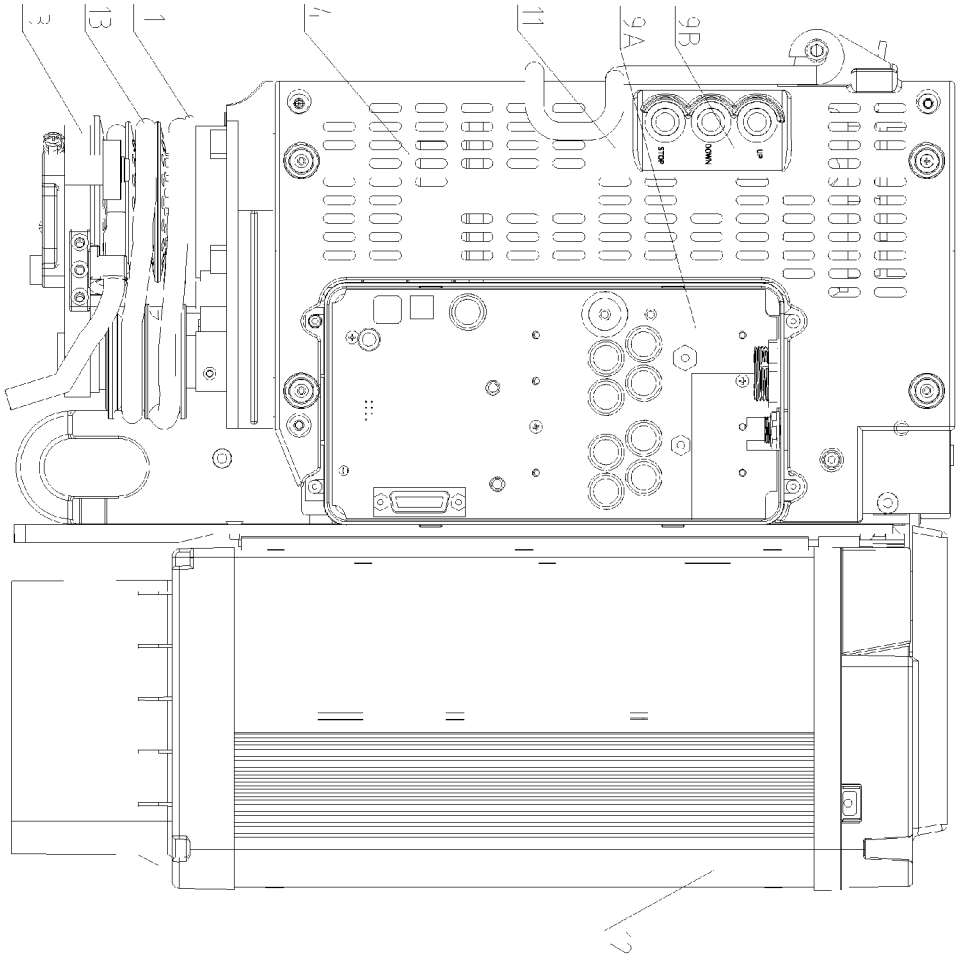
FIG. 1 is a front view illustration of a multi-functional lifting device according to a preferred embodiment of the present invention.
Figure 2:
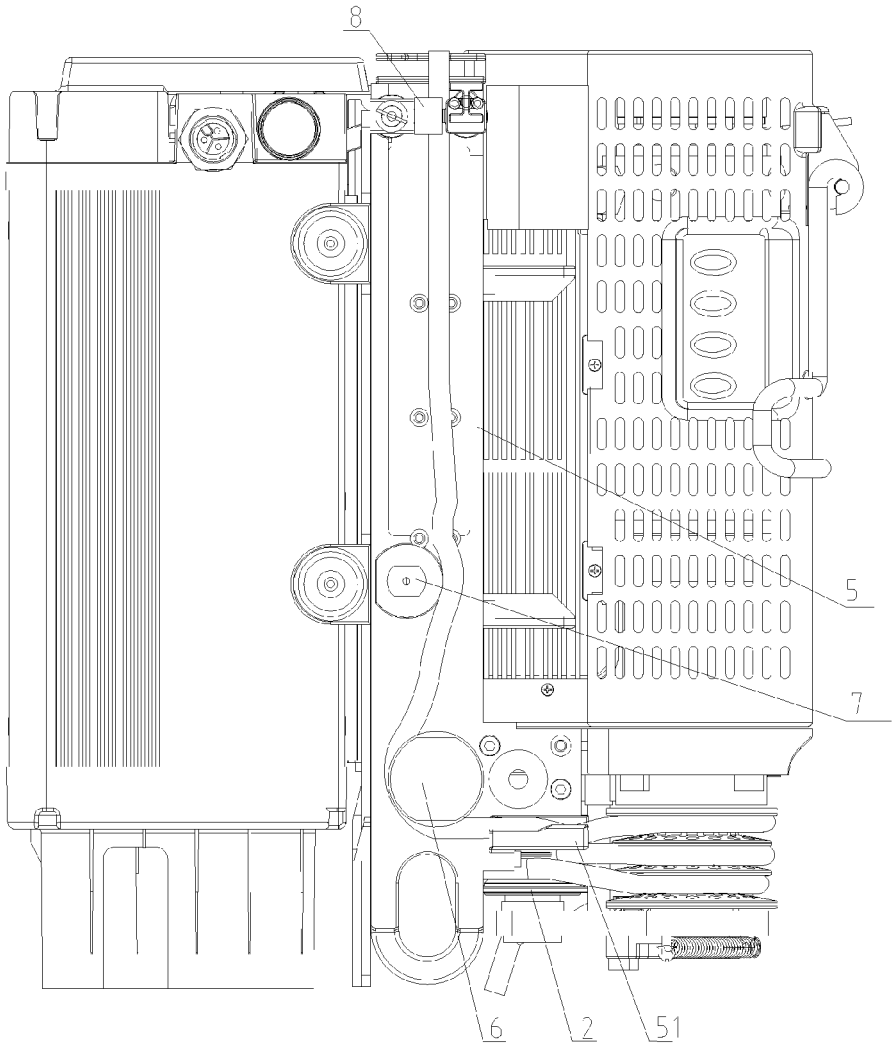
FIG. 2 is a rear view illustration of the multi-functional lifting device according to the above preferred embodiment of the present invention.
Figure 3:
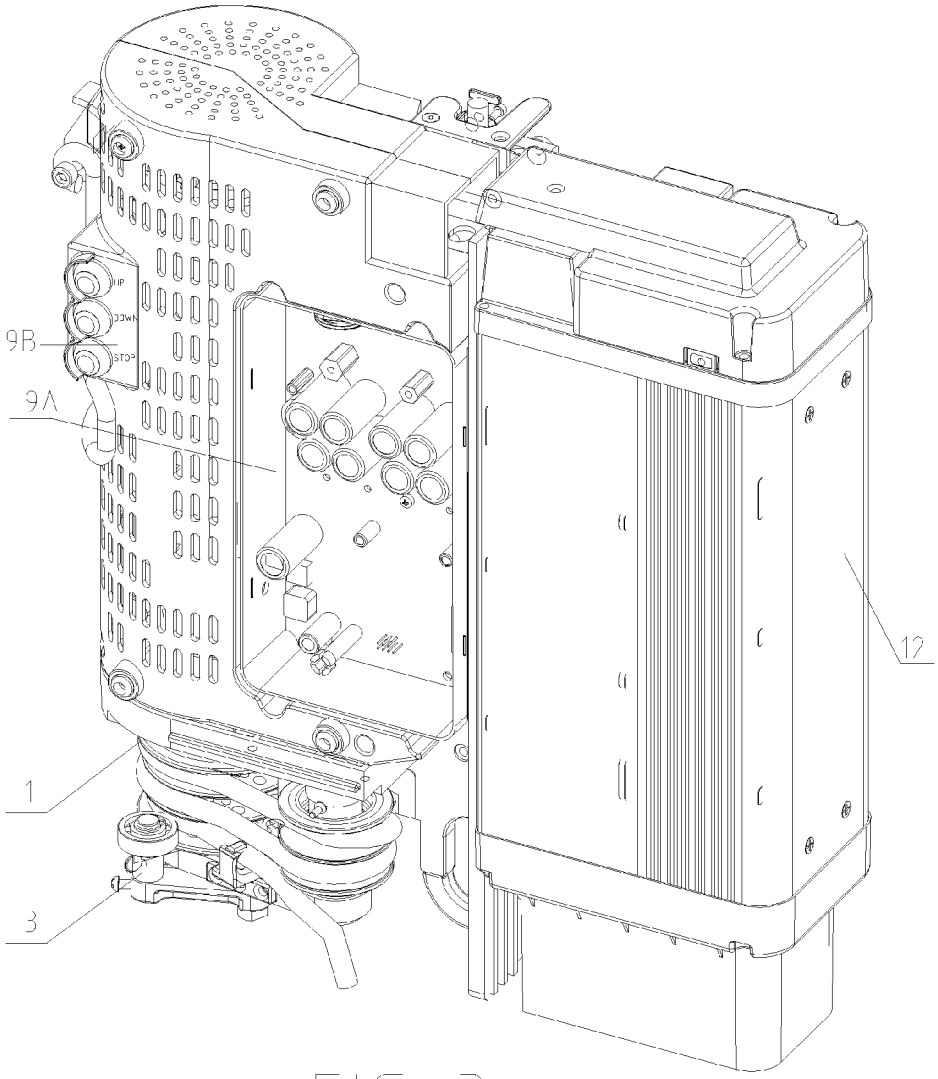
FIG. 3 is a perspective view illustration of the multi-functional lifting device according to the above preferred embodiment of the present invention.
Figure 4:
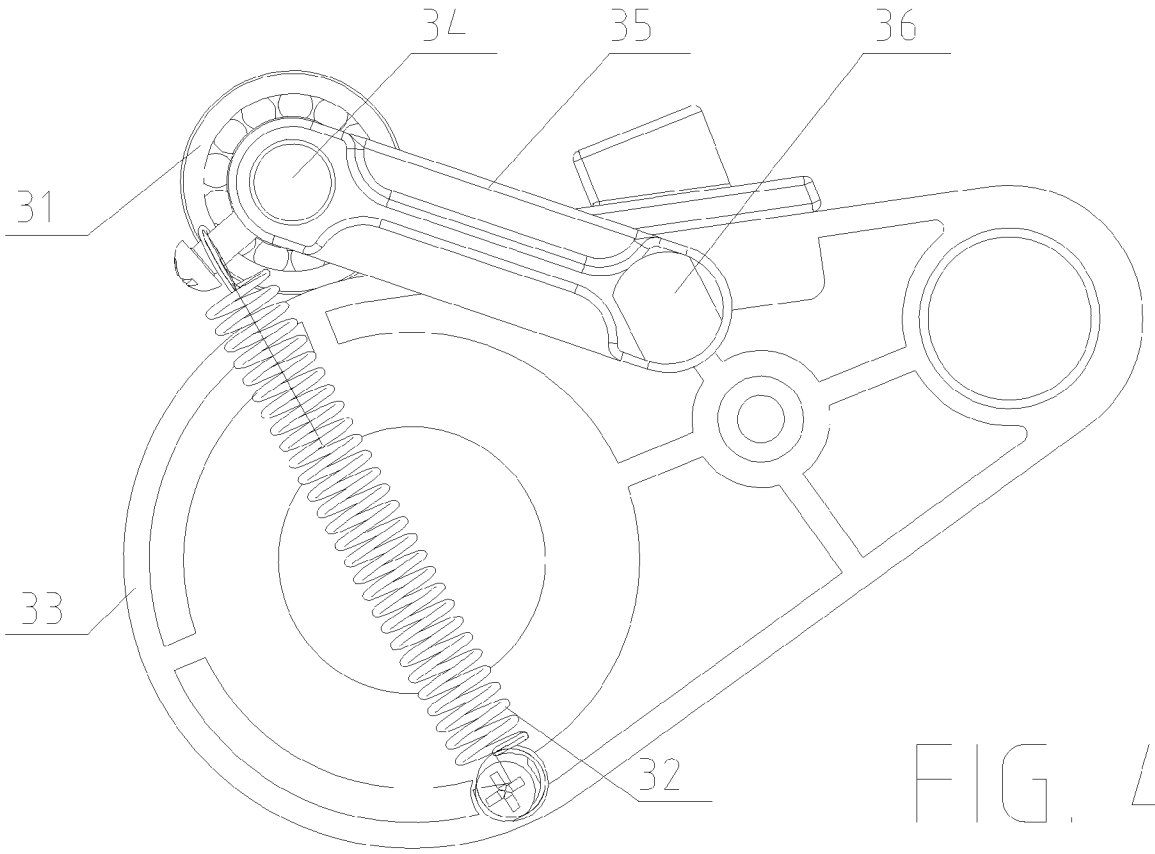
FIG. 4 is a perspective view illustration of the resilient wheel brake unit of the multi-functional lifting device according to the above preferred embodiment of the present invention.

Referring to FIGS. 1, 2, 3 and 4 of the drawings, a multi-functional lifting device according to the preferred embodiment of the present invention comprises a lifting device body 5; a power source 12 such as a battery arrangement provided on the lifting device body 5; an electromagnetic DC motor 11 provided on the lifting device body 5 and electrically connected to the power source 12; a decelerator 4 connected to the DC motor through an input axle of the decelerator 4 and an output axle of the DC motor; a main moving wheel 1 securely positioned at an output axle of the decelerator 4; a rope element 13 twined into a rope groove of the main moving wheel 1; a resilient wheel brake unit 3 provided on an upper portion at one side of the main moving wheel 1 such that the rope element 13 is biased and locked into position; an intermediate wheel 2 positioned at another side of the main moving wheel 1, wherein the intermediate wheel has a rope groove complement to the rope groove of the main moving wheel 1 in such a manner that the rope element 13 is twined continuously between the rope groove of the main moving wheel 1 and the rope groove of the intermediate wheel 2 and extended outside through the rope groove of the main moving wheel 1; a control 9 provided on the lifting device body 5 comprising a speed control module 9B and a PCB board 9A electrically connected together, wherein a signal output terminal of the speed control module 9B is connected to a signal input terminal of the DC motor 11; wherein the resilient wheel brake unit 3 includes a roller 31, a resilient element 32 such as a spring, a roller shaft 35, a roller shaft axle 36, an axle pressing unit 33 and a roller axle 34, wherein the roller 31 is connected to the roller shaft 35 through the roller axle 34, wherein the roller shaft 35 is connected to the axle pressing unit 33 through the roller shaft axle 36, wherein the roller shaft 35 is positioned at a bottom portion of the axle pressing unit 33 and is capable of having rotational movement around the roller shaft axle 36.

Preferably, according to the multi-functional lifting device of the preferred embodiment of the present invention, if the rope groove of the main moving wheel 1 is N, the rope groove of the intermediate wheel 2 is N−1, where N=3, 4, 5, 6.

Preferably, according to the multi-functional lifting device of the preferred embodiment of the present invention, the main moving wheel 1 comprises a rope pressing element 51 provided on an upper portion of the main moving wheel 1, and a steering wheel 6, a guiding wheel 7, and a rope coupling unit 8 provided on top of the rope pressing element 51 respectively, wherein the rope coupling unit 8 comprises two coupling wheels positioned opposite to each other to define a passage and the rope element 13 is arranged to pass through the rope passage and then to the rope groove of the main moving wheel 1 through the guiding wheel 7 and steering wheel 6.

Preferably, according to the multi-functional lifting device of the preferred embodiment of the present invention, a rope exit element is provided on top of the resilient wheel brake unit 3.

Preferably, according to the multi-functional lifting device of the preferred embodiment of the present invention, the lifting device body 5 includes an outer casing, and the outer casing is a water-proof casing, wherein the speed control module 9B of the control 9 includes one or more control button arranged on the water-proof casing such that the control 9 is protected by the water-proof casing while the control button is accessible through the outer casing.

Preferably, according to the multi-functional lifting device of the preferred embodiment of the present invention, the battery arrangement 12 is integrally provided on the lifting device body 5 at one side of the DC motor 11. The battery arrangement may include one or more battery element for providing power supply.

The advantageous features of the present invention is that, first, a person or an object is capable of moving upwardly or downwardly along a climbing rope while ensuring that the upward or downward speed can be controlled through the multi-functional lifting device of the present invention; second, the control and upward and downward movement of the multi-functional lifting device can be controlled through the DC motor, while the multi-functional lifting device is disabled and locked when the power to the DC motor is cut off, and the multi-functional lifting device is capable of moving upwardly and downwardly safely and steadily at a constant speed through the speed control module when the power to the DC motor is cut off; third, resilient wheel brake unit is operatively connected to the main moving wheel in such a manner that a heavy object is prevented from free falling and therefore the impact of the heavy object on the DC motor is minimized or eliminated.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multi-functional lifting device, comprising:

a lifting device body;

a power source supported by and provided on said lifting device body;

an electromagnetic DC motor provided on said lifting device body and electrically connected to said power source;

a decelerator connected to said DC motor through an input axle of said decelerator and an output axle of said DC motor;

a moving wheel securely positioned at an output axle of the decelerator;

a rope element twined into a rope groove of said moving wheel;

a resilient wheel brake unit provided on an upper portion at one side of said moving wheel such that said rope element is capable of being biased and locked into position through said resilient wheel brake unit;

an intermediate wheel positioned at another side of said moving wheel opposite to said side of said resilient wheel brake unit, wherein said intermediate wheel has a rope groove complement to the rope groove of said moving wheel in such a manner that the rope element is twined continuously between the rope groove of said moving wheel and the rope groove of said intermediate wheel and extended outside through the rope groove of said moving wheel; and a speed control module and a PCB board electrically connected together, wherein a signal output terminal of said speed control module is connected to a signal input terminal of said DC motor;

wherein said resilient wheel brake unit includes a roller, a resilient element, a roller shaft, a roller shaft axle, an axle pressing unit and a roller axle, wherein said roller is connected to said roller shaft through said roller axle, wherein said roller shaft is connected to said axle pressing unit through said roller shaft axle, wherein said roller shaft is positioned at a bottom portion of said axle pressing unit and is capable of having rotational movement around said roller shaft axle.

2. The multi-functional lifting device according to claim 1, wherein the number of said moving wheel and the number of said intermediate wheel are correlated, if the number of said moving wheel is N, the number of said intermediate wheel is N−1, where N equals to 3, 4, 5 or 6.

3. The multi-functional lifting device according to claim 1, wherein said moving wheel comprises a rope pressing element provided on an upper portion of said moving wheel, and a steering wheel, a guiding wheel, and a rope coupling unit provided on top of said rope pressing element respectively, wherein said rope coupling unit comprises two coupling wheels positioned opposite to each other to define a rope passage and said rope element is arranged to pass through the rope passage and then to the rope groove of said moving wheel through the guiding wheel 7 and steering wheel 6 respectively.

4. The multi-functional lifting device according to claim 1, comprising a rope exit element on top of said resilient wheel brake unit such that said rope element is extended outside through said rope exit element.

5. The multi-functional lifting device according to claim 1, wherein said lifting device body is a water-proof casing, wherein said speed control module includes one or more control button arranged on said water-proof casing such that said speed control module and said PCB board are protected by said water-proof casing while said control button is accessible through said water-proof casing.

6. The multi-functional lifting device according to claim 1, wherein said power source is a battery unit integrally provided on said lifting device body at one side of said DC motor.

* * * * *